United States Patent [19]

Millar

[11] 4,132,439

[45] Jan. 2, 1979

[54] DOOR LOCK APPARATUS

[75] Inventor: Frederick W. Millar, Frankston, Australia

[73] Assignee: Access Control Systems Pty. Ltd., Melbourne, Australia

[21] Appl. No.: 742,742

[22] Filed: Nov. 18, 1976

[30] Foreign Application Priority Data

Nov. 21, 1975 [AU] Australia ..... PC4055

[51] Int. Cl.[2] ..... E05B 47/00

[52] U.S. Cl. ..... 292/144; 70/279

[58] Field of Search ..... 292/34, 40, 92, 144, 292/165, 166, 173; 70/92, 277, 278, 279, 280, 281, 282, 283

[56] References Cited

U.S. PATENT DOCUMENTS

| | | | |
|---|---|---|---|
| 450,068 | 4/1891 | Grefen | 292/173 X |
| 2,223,050 | 11/1940 | Scragg | 292/40 X |
| 2,765,648 | 10/1956 | Hatcher | 70/283 X |
| 2,786,701 | 3/1957 | Povlick | 292/144 |
| 2,828,151 | 3/1958 | Brotman et al. | 292/144 |
| 3,750,433 | 8/1973 | Sanders | 292/165 X |
| 3,751,088 | 8/1973 | Schlage | 70/279 X |
| 3,765,709 | 10/1973 | Wyck | 292/144 X |
| 3,869,159 | 3/1975 | Eads | 292/92 |
| 3,872,696 | 3/1975 | Geringer | 292/34 X |

FOREIGN PATENT DOCUMENTS

| | | | |
|---|---|---|---|
| 10446 | 1/1903 | Austria | 292/144 |
| 962717 | 2/1975 | Canada | 292/165 |
| 2504774 | 8/1975 | Fed. Rep. of Germany | 292/144 |
| 456440 | 2/1975 | France | 292/165 |

*Primary Examiner*—James T. McCall
*Assistant Examiner*—Thomas J. Holko
*Attorney, Agent, or Firm*—Biebel, French & Nauman

[57] ABSTRACT

Door locking apparatus including electrically operated lock mounted in door surround structure and electrically operable to thrust lock bolt into recess in door. Door carries lock over-ride mechanism manually operable from one side of the door to push lock bolt from recess in event of power failure to allow emergency exit. Over-ride mechanism may be interconnected with conventional latch mechanism on door such that latch is operable from both sides of doors to control entry and exit when electrically operated lock is switched off during periods when security not necessary.

9 Claims, 7 Drawing Figures

DOOR LOCK APPARATUS

BACKGROUND OF THE INVENTION

This invention relates to door locking apparatus.

It is known to provide electrically operated door locking apparatus in which an elongate lock bolt is moved longitudinally between retracted and extended positions by solenoid action and to provide in such apparatus a dead-locking element which can also be moved by solenoid action between a dead locking position in which it engages the lock bolt to hold the lock bolt in the extended position and a withdrawn, bolt freeing position. Apparatus of this type is satisfactory for many purposes and has particular application where it is desirable to be able to lock and unlock the door from a remote location. However, conventional locking apparatus of this type will usually remain in a locked condition in the event that there is a failure of the power supply to the door and in some applications this can contravene safety requirements for emergency situations. On the other hand, a lock which opened automatically in the event of power failure would not be satisfactory from the standpoint of security. The present invention provides a locking apparatus including an electrically operated lock bolt and which ensures that the door will remain locked in the event of a power failure but which nevertheless allows the door to be opened from one side in an emergency situation without application of electrical power.

The apparatus of the present invention may also include a manually operable latch mechanism in addition to the electrically operated lock bolt to enable a door installation in which both entry and exit through the door is achieved by operation of the latch mechanism but is normally conditional upon prior electrically powered withdrawal of the lock bolt and in the event of power failure entry through the door is prevented but emergency exit is permitted by manual actuation from the inside of the door.

SUMMARY OF THE INVENTION

According to the invention there is provided, in combination, a door surround structure defining the doorway;

a door pivotally mounted on the surround structure so as to be swingable in the doorway between open and closed positions;

a lock structure mounted in the door surround structure and comprising a lock bolt slidable between retracted and extended positions, first electric power means operable to move the lock bolt from its retracted position to its extended position, a bolt locking element which has a bolt locking position in which it engages the bolt to hold the bolt in its extended position and which is biased toward a bolt freeing position and second electric power means operable to hold the bolt locking element in its bolt locking position;

a recess in the door to receive the extended end of the lock bolt when the door is in the closed position and the lock bolt is extended; and a mechanism operable manually from one side of the door such as to be capable of pushing the lock bolt clear of said recess when the second electric power means is inoperative.

Preferably, there is a third electric power means operable to move the lock bolt from its extended position to its retracted position and the second electric power means and the third electric power means are electrically interconnected such that operation of the third electric power means is accompanied by de-energisation of the second power means.

Preferably too, said mechanism comprises a plunger slidable in said recess in the direction of movement of the lock bolt between its extended and retracted positions, a push member mounted exteriorally of the door at said one side of the door so as to be movable toward and away from the face of the door at said one side of the door and connection means extending through said face of the door and connecting the push member and the plunger so as to be responsive to movement of the push member toward said face of the door to cause movement of the plunger within the recess toward the mouth of the recess.

In order that the invention may be more fully explained one particular embodiment will be described in detail with reference to the accompanying drawings.

DESCRIPTION OF THE PREFERRED EMBODIMENT

Figure 1:
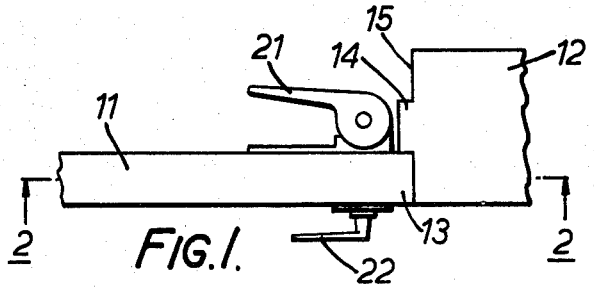
FIG. 1 is a plan of part of a door installation incorporating locking apparatus in accordance with the present invention.

The illustrated door installation comprises a door 11 mounted within a door surround structure 12. The inner end of the door (not shown) may be hinged to the door surround structure in conventional fashion and when the door is closed its outer or swinging end 13 engages a stop rib 14 projecting inwardly from the inner face 15 of structure 12 at the appropriate side of the doorway.

The illustrated installation includes a locking apparatus comprised of an electrically operated dead lock denoted generally as 16 which is installed in door surround structure 12 and a manually actuable mechanism denoted generally as 17 which is mounted on the door adjacent its outer end 13 and which comprises a sliding plunger 18, a latch bolt 19, a push plate 21 at one side of the door and a latch handle 22 at the other side of the door.

Figure 2:
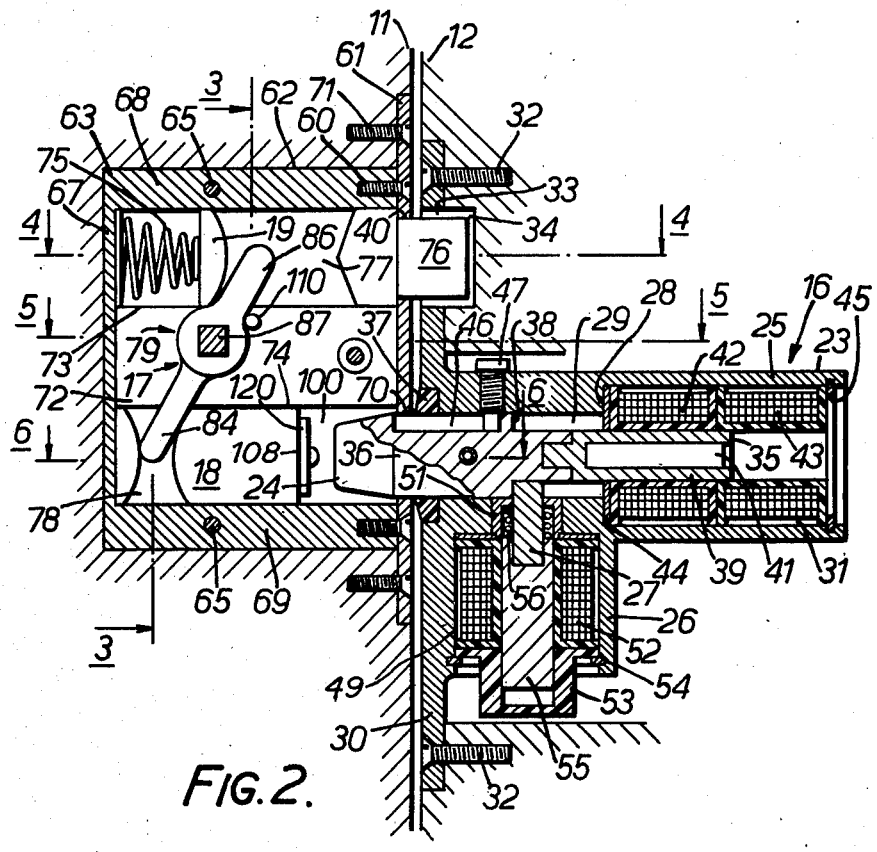
FIG. 2 is a cross section on the line 2—2 in FIG. 1.
Figure 3:
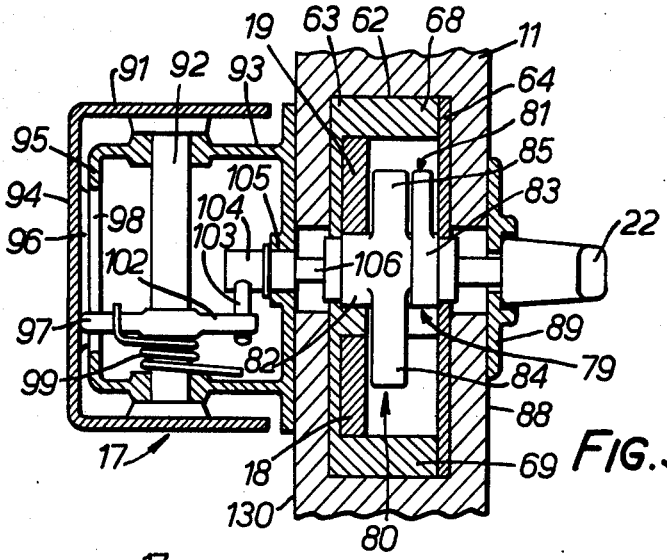
FIG. 3 is a cross section generally on the line 3—3 in FIG. 2.
Figure 4:
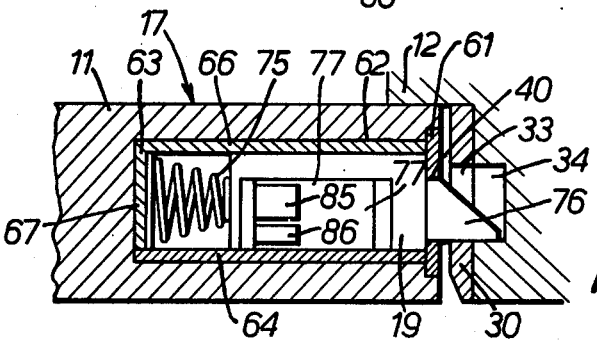
FIG. 4 is a cross section on the line 4—4 in FIG. 2.
Figure 6:
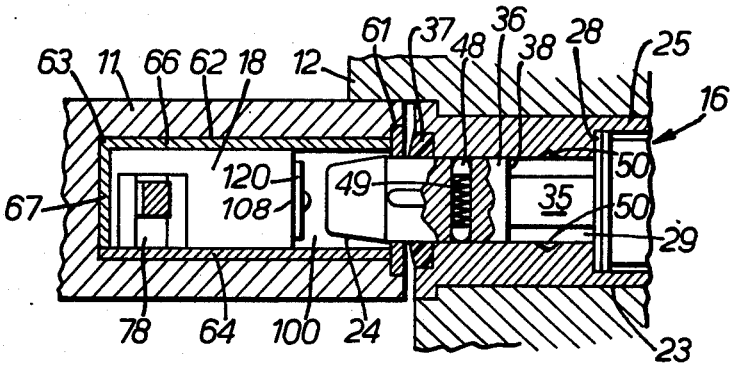
FIG. 6 is a cross section on the line 6—6 in FIG. 2.
Figure 7:
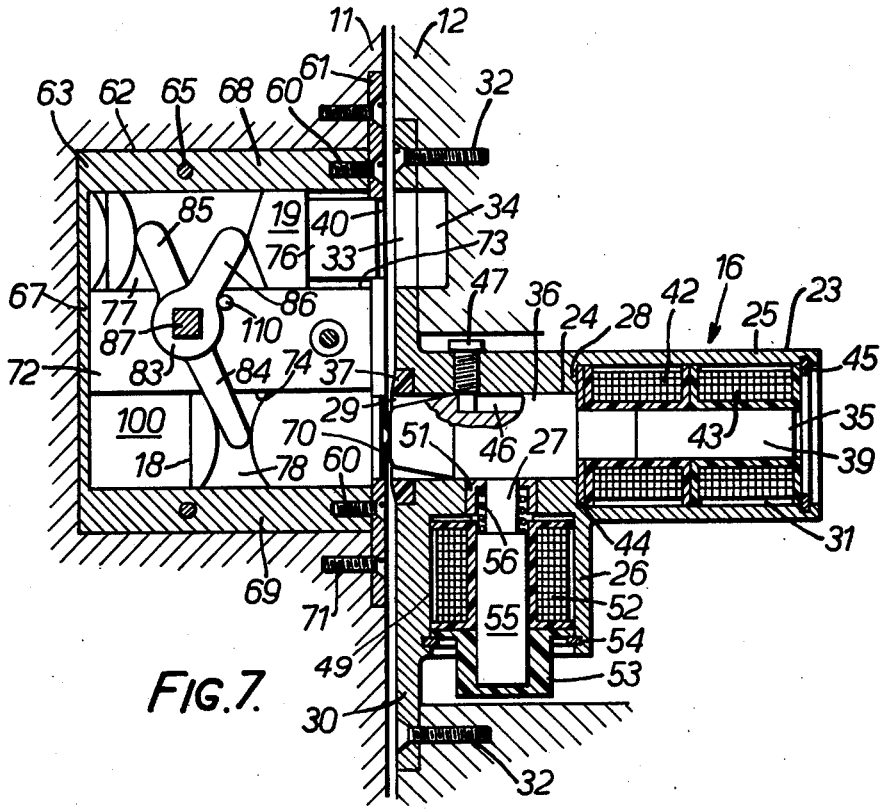
FIG. 7 is a cross section similar to that of FIG. 2 but showing the locking apparatus in a different condition.

Electrically operated dead lock 16 comprises a body 23 and an elongate lock bolt 24 slidable within that body between extended and retracted positions shown respectively in FIGS. 2 and 7. Body 23 is formed of a non-magnetic material. It may for example be a zinc based die-casting. It is comprised of a rectangular face plate 30, a main body tube 25 extending rearwardly from face plate 30 and a branch tube 26 which is perpendicular to tube 25 and branches from it immediately behind face plate 30.

Main body tube 25 houses the elongate lock bolt 24 and equipment for moving the lock bolt longitudinally within it and branch tube 26 houses a dead-locking pin 27 which is perpendicular to lock bolt 24. The interior of main tube 25 is stepped at 28 between a relatively small diameter bore 29 extending back from face plate 30 and a larger diameter bore 31 extending through to the rear end of the tube. Face plate 30 has counter-sunk holes to receive mounting screws 32 and a rectangular slot 33 through which latch bolt 19 can be extended to project into a recess 34 formed in door surround structure 12.

Lock bolt 24 is comprised of a bolt stem 35 and a bolt head 36 which has a cylindrical main portion and forwardly convergent nose portion. Bolt head 35 is slidable within the bore 29 of body tube 25 and through a PTFE bush 37 fitted to the front end of bore 29. Bolt stem 35 is of considerably smaller diameter than the bolt head so that a rearwardly facing shoulder 38 is defined at the junction between the bolt stem and the bolt head.

Lock bolt 24 is movable longitudinally within body tube 25 between the extended position shown in FIG. 2 in which bolt head 36 extends forwardly from face plate 30 and a retracted position in which its head is withdrawn into the body as shown in FIG. 7. In both of these positions bolt stem 35 extends rearwardly into the relatively large diameter bore 31 of body tube 25 although to differing degrees.

Bolt head 36 and bolt stem 35 are formed from two components made of different materials and tightly fitted together. More particularly, the bolt head and a short length of the stem are formed of a non-magnetic material such as brass and the rear end part of the stem is formed by a tube 39 of magnetic material such as mild steel. The bore of tube 39 houses a bar magnet 41.

The large diameter bore 31 of body tube 25 houses a pair of solenoids 42, 43 disclosed about the axis of bolt stem 35. These solenoids are each comprised of a coil mounted on an insulating bobbin-type carrier. The two carriers abut one another in end-to-end relation and they are disposed between an annular steel spacer plate 44 and a retaining circlip 45 which holds them in place within body tube 25.

Lock bolt 24 can be moved from its extended position to the retracted position by energisation of solenoid coil 43 (assuming that dead locking pin 27 has been released as will be described below) and can be moved back from its retracted position to the extended position by energisation of solenoid coil 42. The solenoid coils act on that part of the bolt stem which is made of magnetic material and the presence of bar magnet 41 further enhances the forces generated on the bolt by the solenoid coils.

A longitudinal slot 46 formed in the bolt head is engaged by a pin 47 extending radially inwardly of body tube 25 to prevent the bolt from rotating and to set accurate limits for its forward and rearward travel. The bolt head is also fitted with a pair of detent balls 48 which are mounted within a bore extending diametrically through the bolt head and which are biased radially outwardly by a detent biasing spring 49 located within the bore to act directly between the detent balls. Detent balls 48 engage recesses 50 in the wall of body tube 25 when the bolt is in its retracted position so as to hold the bolt against dislodgement from the retracted position when the solenoids are not energised. However, the detent action is overcome by the energisation of solenoid coil 42 when the bolt is to be extended and the balls 48 then roll in the bore 29 of the body.

Body branch tube 26 has a bore 49 extending inwardly to a smaller diameter bore which breaks into the bore 29 of body tube 25 and is fitted with a brass bushing 51 to provide a sliding bearing for dead locking pin 27. Bore 49 receives a dead-lock solenoid 52 which is held in position by a solenoid cap 53 retained by a circlip 54. Dead-locking pin 27 is formed of stainless steel and is mounted on a mild steel plunger 55 which serves as an armature for the solenoid 52. The dead-locking pin and plunger are biased downwardly from the lock bolt both by gravity and also by a light coil spring 56 but can be raised by the action of solenoid 52 on plunger 55 so that the dead-locking pin engages the lock bolt.

When lock bolt 24 is extended and solenoid 52 is energised, dead-locking pin 27 is raised so as to project behind shoulder 38 at the rear end of the bolt head and the bolt is then locked against movement to its retracted position. In order to retract the lock bolt, dead-lock solenoid 52 must be de-energised to allow the dead-locking pin to move downwardly and solenoid coil 43 energised to retract the lock bolt. The two solenoids may receive only short electrical pulses to achieve these movements and they may be interconnected by simple sequencing logic or timer circuitry to ensure that solenoid 52 is de-energised slightly before solenoid 43 is energised to retract the lock bolt.

Solenoids 42 and 53 may be energised together or delay circuitry may be included to cause solenoid 42 to be energised slightly before solenoid 53. Solenoid 42 may receive only a pulse to move the lock bolt but solenoid 53 must receive a continuous electrical current to hold the dead-locking pin in its locking position. A door actuated switch may be provided in the circuit so as to isolate all of the solenoids when the door is opened, thereby to prevent any movement of the lock bolt or dead-locking pin until the door is re-closed. This switch may initiate the energisation of solenoids 42 and 53 when the door is re-closed.

Manually actuable mechanism 17 carried on door 11 has a body comprising a face plate 61 and a rectangular casing 62 fitted into a rectangular recess in the outer edge of the door. Casing 62 is formed by two casing members 63, 64 which are held together by clamping screws 65. Casing member 63 defines one side wall 66, the back wall 67 and the top and bottom walls 68, 69 of the casing and the other member 64 defines the other side wall of the casing. Front plate 61 is secured to the casing by screws 60 and to the outer edge of the door by screws 71. The front plate has a circular opening 70 through which lock bolt 37 of lock 16 projects into the casing when in its extended position and a rectangular slot 40 through which latch bolt 19 of mechanism 17 is extended.

The side wall 66 defined by casing member 63 has a central raised land or rib 72 the upper and lower edges 73, 74 of which serve as guides for latch bolt 19 and plunger 18 respectively. More particularly, plunger 18 comprises a rectangular bar which is slidable horizontally within the lower part of the casing between the bottom facing wall 69 and shoulder 74 and latch bolt 19 comprises a rectangular bar which is slidable horizontally in the casing between the upper casing wall 68 and shoulder 73. Plunger 18 is aligned with lock bolt 24. It is therefore slidable within a recess 100 defined within the door by the casing 62 which recess has a mouth defined by the hole 70 in face plate 61 and receives the forward end of lock bolt 24 when the lock bolt is extended. Latch bolt 19 is biased by means of a conical compression spring 75 toward its extended position in which its rectangular bar portion within the casing abuts front plate 61 and a front tongue portion 76 projects through the rectangular slots 80 and 33 in face plates 61 and 30 into recess 34 in door surround structure 12. An elongate slot 77 is formed in one side of latch bolt 19 and a rather narrower slot 78 is formed in one side of plunger 18 and these slots are engaged by a lever structure which is denoted generally as 79 and which is mounted by engagement with openings in the side walls of the casing disposed between latch bolt 19 and plunger 18.

Lever assembly 79 comprises two lever structures 80, 81 having central boss portions 82, 83 respectively which interfit together and which are journalled in the openings in the side walls of the casing so that the two lever structures are independently rotatable about a common horizontal axis disposed between latch bolt 19 and plunger 18. Lever structure 80 has two oppositely directed levers 84, 85 which are formed integrally with hub 82 and which respectively engage slot 78 in plunger 18 and slot 77 in latch bolt 19. Lever structure 81 has a single lever 86 which is formed integrally with the respective hub 83 and which engages the slot 77 in latch bolt 19.

The hub 82 of lever structure 80 is coupled to a rectangular shaft 90 which, by means of a mechanism to be described below, is rotated by actuation of push plate 21. The hub 83 of lever structure 81 is coupled to a second rectangular shaft 87 which is co-axial with shaft 90 and extends through the face 88 of door 11 and carries latch handle 22 at its outer end. An escutcheon plate 89 is mounted between latch handle 22 and door face 88.

On rotation of shaft 90 and levers 84, 85 consequent to actuation of push plate 21, the engagement of lever 85 with latch bolt slot 77 causes the latch bolt to be withdrawn to its retracted position and the engagement of lever 83 with plunger slot 78 causes the plunger 18 to be simultaneously moved toward the mouth of recess 100 as indicated in FIG. 7. Because of the elongation of latch bolt slot 77 the movement of the latch bolt does not cause movement of lever structure 81 which remains in engagement with a stop pin 110 as also indicated in FIG. 7. By actuation of latch handle 22, moved independently of levers 84, 85 to withdraw the latch bolt. The purpose of this independent operation will be explained below.

Figure 5:
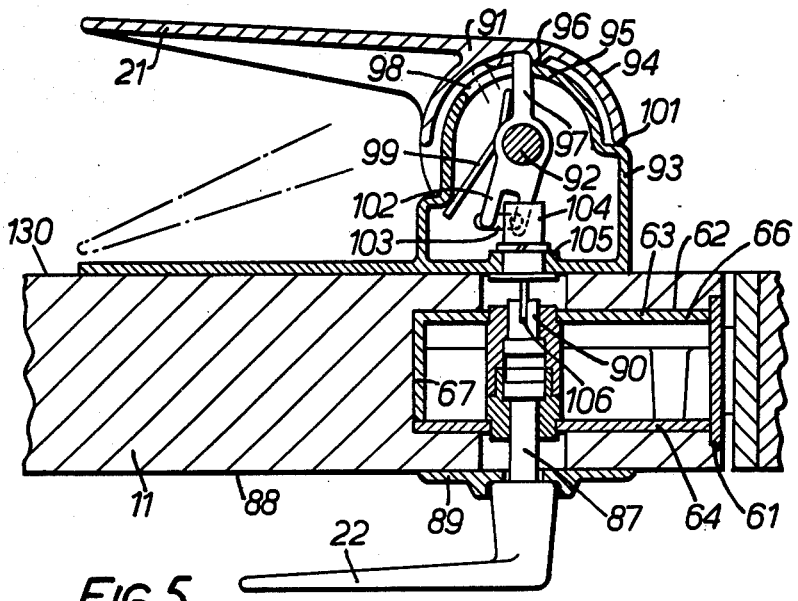
FIG. 5 is a cross section on the line 5—5 in FIG. 2.

The mechanism interconnecting push plate 21 and lever shaft 86 will now be described. Push plate 21 is formed as part of a pivot structure 91 which is pivoted by means of a shaft 92 on a bracket 93 fastened to the inner face 130 of door 11. Pivot structure 91 has a cylindrical portion 94 which is disposed about the axis of shaft 92 and fits around a co-axial cylindrical portion 95 of bracket 93. Cylindrical portion 94 of the pivot structure has an inwardly projecting rib 96 which is engaged by one arm of a double arm lever 97 rotatable on shaft 92. This lever arm projects through a slot 98 in the cylindrical portion 95 of bracket 93. Lever 97 is biased about shaft 92 by a torsion spring 99, so as to urge pivot structure 91 to the position shown by solid lines in FIG. 5, which position is determined by engagement of the end 101 of cylindrical portion 94 with the bracket 93. When the pivot structure is in this position push plate 21 is almost parallel with door face 94. The push plate can be pushed toward door face 94 against the action of biasing spring 99 to the position shown in dotted outline in FIG. 5, thereby to cause rotation of lever 97.

The other arm of double lever 97 is forked and the two fork prongs 102 project one to either side of a pin 103 projecting radially outwardly from the end of a stub shaft 104 which is perpendicular to shaft 92 and is journalled within a boss 105 formed in bracket 93. Stub shaft 104 is coupled to rectangular shaft 86 via a resilient torsion strip 106 which fits into slots in the respective shafts. This completes a simple form of right-angle drive mechanism whereby rotation of lever 97 consequent to actuation of push plate 21 causes rotation of shaft 104 and, through torsion strip 106, of rectangular shaft 86.

From the above description it will be appreciated that latch bolt 19 can be withdrawn by actuation of either push plate 21 or latch handle 22. Actuation of push plate 21 also tends to move plunger 18 toward the mouth of recess 100. The purpose of plunger 18 is to push lock bolt 24 out of recess 100 in the event that there has been a power failure. In that event dead lock pin 61 of lock 16 will drop but lock bolt 24 will remain in its extended position so that the door will remain locked and the door cannot be opened by actuation of latch handle 22. However, actuation of push plate 21 will not only withdraw latch bolt 19 but will also move plunger 18 to push lock bolt 24 out of recess 100 so that the door can be opened.

The main body of plunger 18 is captive within recess 100 but it has a cylindrical nose 120 which fits into the mouth of the recess defined by face plate hole 70 and carries a spring-loaded ball 108 which does project from the mouth of the recess when the plunger is moved so as to push lock bolt 24 clear from the door. Ball 108 can be pushed back against its spring loading if it meets an obstruction during the subsequent opening movement of the door.

If push plate 21 is actuated while lock bolt 24 is deadlocked in its extended position, the lock bolt will not be moved and the movement of the push plate 21 will be taken up by flexure of torsion strip 106. The torsion strip can also take up any excess movement of push plate 22 when lock bolt 24 is being pushed by plunger 18 back to its retracted position.

Typically the illustrated installation will be used for controlling access to and from a building where security is to be maintained for limited periods only, for example during the night. When security is not required, for example during the day, the electrically operated lock 16 is switched off and lock bolt 24 remains in its retracted position. The door then serves as a simple latch operated door, entry being achieved from outside the door by actuation of latch handle 22 and egress by actuation of push plate 21. When maximum security is required, lock 16 is electrically operated to hold lock bolt 24 in its extended position. This completely prevents access from outside the door since operation of latch handle 22 only moves latch bolt 19 and is completely ineffective to move the lock bolt. Provided there is no failure in the power supply the door can only be opened from the inside by firstly operating electric lock 16 to withdraw lock bolt 24 and then actuating push plate 21. Lock 16 may be operated by a key actuated device which can be mounted adjacent the door or at some remote location. Conveniently this device may be a reader unit to read magnetically coded keys and to send appropriate electric signals to lock 16.

In the event of a power failure the door may still be opened by simple actuation of push plate 21 which then causes plunger 18 to push lock bolt 24 clear of recess 100 while simultaneously withdrawing latch bolt 19. The door can thus be opened from the inside in an emergency situation but there is no loss of security against access from outside the door.

I claim:

1. The combination of a door surround structure defining a doorway, a door pivotally mounted on said surround structure so as to be swingable in the doorway between open and closed positions, a lock structure mounted in the door surround structure and comprising a lock bolt slidable between retracted and extended positions, first electric power means operable to move said lock bolt from its retracted position to its extended position, a bolt locking element which has a bolt locking position in which it engages said lock bolt to hold said lock bolt in its extended position and which is biased toward a bolt freeing position, and second electric power means operable to hold said bolt locking element in its bolt locking position, a recess in the door to receive the extended end of said lock bolt when said door is in its closed position and said lock bolt is extended, and a mechanism operable manually from one side of said door such as to be capable of pushing said lock bolt clear of said recess when the second electric power means is inoperative, which mechanism comprises a plunger slidable in said recess in the direction of movement of said lock bolt between its extended and retracted positions, a hand actuable member mounted exteriorly on the face of said door at said one side of said door and connector means extending through said face of said door and connecting said hand actuable member and said plunger so as to be responsive to actuation of said hand actuable member to cause movement of said plunger within said recess toward the mouth of said recess.

2. The combination of claim 1, further comprising a third electric power means operable to move said lock bolt from its extended position to its retracted position, and means electrically interconnecting said second electric power means and said third electric power means such that operation of said third electric power means is accompanied by deenergization of said second electric power means.

3. The combination of a door surround structure defining a doorway, a door pivotally mounted on said surround structure so as to be swingable in said doorway between open and closed positions, a lock structure mounted in said door surround structure and comprising a lock bolt slidable between retracted and extended positions, first electric power means operable to move said lock bolt from its retracted position to its extended position, a bolt locking element which has a bolt locking position in which it engages said bolt to hold said bolt in its extended position and which is biased toward a bolt freeing position, and second electric power means operable to hold said bolt locking element in its bolt locking position, a recess in said door to receive the extended end of said lock bolt when said door is in its closed position and said lock bolt is extended, and a mechanism operable manually from one side of said door such as to be capable of pushing said lock bolt clear of said recess when said second electric power means is inoperative, wherein said mechanism comprises a plunger slidable in said recess in the direction of movement of said lock bolt between its extended and retracted positions, a push member mounted exteriorally on the face of the door at said one side of the door so as to be movable toward and away from said face of said door and connection means extending through said face of said door and connecting said push member and said plunger so as to be responsive to movement of said push member towards said face of said door to cause movement of said plunger within said recess toward the mouth of the recess.

4. The combination claimed in claim 3, wherein said connection means includes a resiliently deformable element to permit said push member to move toward said door face without moving said lock bolt in the event that said push member is actuated while said second power means is operative, thereby to hold said lock bolt in its extended position against movement by the action of the plunger.

5. The combination claimed in claim 3, wherein said plunger comprises a plunger body which is captive within said recess and a plunger tip element which is spring loaded with respect to said body so as to project from said recess on operation of said mechanism thereby to push said lock bolt clear of said recess but is then retractable into said recess against the action of its spring loading.

6. The combination of a door surround structure defining a doorway, a door pivotally mounted on said surround structure so as to be swingable in said doorway between open and closed positions, a lock structure mounted in said door surround structure and comprising a lock bolt slidable between retracted and extended positions, first electric power means operable to move said lock bolt from its retracted position to its extended position, a bolt locking element which has a bolt locking position in which it engages said bolt to hold said bolt in its extended position and which is biased toward a bolt freeing position, and second electric power means operable to hold said bolt locking element in its bolt locking position, a recess in said door to receive the extended end of said lock bolt when said door is in its closed position and said lock bolt is extended, a mechanism operable manually from one side of said door such as to be capable of pushing said lock bolt clear of said recess when the second electric power means is inoperative, a latch mechanism mounted on the door and including a latch bolt movable between a retracted position and an extended position in which it projects from the outer edge of said door and a latch handle manually operable from the side of said door opposite to said one side to move said latch bolt between its extended and retracted positions, a latch bolt check in said door surround structure to engage the extended end of the latch bolt when the door is in its closed position and the latch bolt is extended, and mechanical means interconnecting said mechanism operable manually from one side of said door and said latch bolt whereby operation of said mechanism operable manually from one side of said door also moves the latch bolt from its extended position to its retracted position.

7. The combination claimed in claim 6 and further comprising a latch handle manually operable from the side of said door opposite to said one side to move said latch bolt between its extended and retracted positions, wherein said lock bolt and said latch bolt are spaced vertically apart with their lines of movement parallel with one another, said connection means comprises a first horizontal shaft disposed between said lock bolt and said latch bolt and rotatable by actuation of said push member, and a first lever rotatable with said shaft and extending therefrom to engage said plunger whereby rotation of said shaft causes sliding movement of said plunger in said recess, and in which is provided a second lever, rotatable with said shaft and extending oppositely from the first said lever, to engage said latch bolt whereby rotation of said shaft to move said plunger via said first said lever toward the mouth of said recess also causes, via said second lever, movement of the latch bolt from its extended position to its retracted position but movement of said latch bolt consequent to actuation of the latch handle does not move said second lever.

8. The combination claimed in claim 7, wherein said latch mechanism comprises a second horizontal shaft rotatable independently of said first horizontal shaft by actuation of said latch handle and a third lever rotatable with said second horizontal shaft and engaged with said latch bolt whereby rotation of said second horizontal shaft causes said third lever to move said latch bolt.

9. The combination claimed in claim 6, wherein said latch mechanism comprises a second shaft co-axial with and rotatable independently of said first horizontal shaft by actuation of said latch handle and a third lever rotatable with said second shaft, and said second and third levers engage a slot in said latch bolt so that said latch bolt can be moved from its extended position to its retracted position by rotation of either of said second and third levers without causing movement of the other of said second and third levers.

* * * * *

UNITED STATES PATENT AND TRADEMARK OFFICE

CERTIFICATE OF CORRECTION

PATENT NO. : 4,132,439

DATED : January 2, 1979

INVENTOR(S) : Frederick William Millar

It is certified that error appears in the above-identified patent and that said Letters Patent are hereby corrected as shown below:

Under "References", "France - Feb. 1975" should be --France - June 1913--

Column 10, line 11, "claim 6" should be --claim 7--

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*